US006238324B1

(12) United States Patent
MacMillan

(10) Patent No.: US 6,238,324 B1
(45) Date of Patent: May 29, 2001

(54) ELASTIC EXERCISER SYSTEM

(76) Inventor: Gordan A. MacMillan, 234 Tilehurst Road, Reading, Berks, RG30 2NE (GB)

( * ) Notice: Subject to any disclaimer, the term of this patent is extended or adjusted under 35 U.S.C. 154(b) by 0 days.

(21) Appl. No.: 09/489,565

(22) Filed: Jan. 21, 2000

(51) Int. Cl.[7] ..... A63B 21/02

(52) U.S. Cl. ..... 482/121; 482/12; 482/126; 482/124

(58) Field of Search ..... 482/148, 124, 482/121, 126, 139, 125, 907

(56) References Cited

U.S. PATENT DOCUMENTS

| | | | | |
|---|---|---|---|---|
| D. 346,632 | | 5/1994 | Castellanos . | |
| D. 368,501 | | 4/1996 | Woodruff . | |
| 2,224,103 | | 12/1940 | Nilson . | |
| 3,256,015 | * | 6/1966 | Perrin | 482/121 |
| 4,026,549 | | 5/1977 | Gunn . | |
| 4,245,840 | | 1/1981 | Van Housen . | |
| 5,203,754 | * | 4/1993 | Maclean | 482/124 |
| 5,571,064 | | 11/1996 | Holm . | |
| 6,036,625 | * | 3/2000 | Woodruff | 482/121 |

* cited by examiner

*Primary Examiner*—Jerome W. Donnelly

(57) ABSTRACT

A elastic exerciser system for providing a portable exercise system so that a user may exercise therewith at any location. The elastic exerciser system includes a plurality of elastic loads with each end of each elastic load having a fastening ring coupled thereto. A pair of elongate cords are provided also having a fastening ring couple to each end of the respective cord. Each cord also has a plurality of spaced apart and laterally positioned fastening rings coupled thereto between the ends of the respective cord. A pair of flexible annular handles are provided each having a fastening ring coupled thereto. A plurality of detachably fasteners are provided for detaching pairs of the fastening rings together into various configurations to permit a user to perform various resistance exercises.

9 Claims, 3 Drawing Sheets

ELASTIC EXERCISER SYSTEM

BACKGROUND OF THE INVENTION

1. Field of the Invention

The present invention relates to exerciser systems and more particularly pertains to a new elastic exerciser system for providing a portable exercise system so that a user may exercise therewith at any location.

2. Description of the Prior Art

The use of exerciser systems is known in the prior art. More specifically, exerciser systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,245,840; U.S. Pat. No. 4,026,549; U.S. Pat. No. Des. 346,632; U.S. Pat. No. 2,224,103; U.S. Pat. No. Des. 368,501; and U.S. Pat. No. 5,571,064.

While these devices fulfill their respective, particular objectives and requirements, the aforementioned patents do not disclose a new elastic exerciser system. The inventive device includes a plurality of elastic loads with each end of each elastic load having a fastening ring coupled thereto. A pair of elongate cords are provided also having a fastening ring couple to each end of the respective cord. Each cord also has a plurality of spaced apart and laterally positioned fastening rings coupled thereto between the ends of the respective cord. A pair of flexible annular handles are provided each having a fastening ring coupled thereto. A plurality of detachably fasteners are provided for detaching pairs of the fastening rings together into various configurations to permit a user to perform various resistance exercises.

In these respects, the elastic exerciser system according to the present invention substantially departs from the conventional concepts and designs of the prior art, and in so doing provides an apparatus primarily developed for the purpose of providing a portable exercise system so that a user may exercise therewith at any location.

SUMMARY OF THE INVENTION

In view of the foregoing disadvantages inherent in the known types of exerciser systems now present in the prior art, the present invention provides a new elastic exerciser system construction wherein the same can be utilized for providing a portable exercise system so that a user may exercise therewith at any location.

The general purpose of the present invention, which will be described subsequently in greater detail, is to provide a new elastic exerciser system apparatus and method which has many of the advantages of the exerciser systems mentioned heretofore and many novel features that result in a new elastic exerciser system which is not anticipated, rendered obvious, suggested, or even implied by any of the prior art exerciser systems, either alone or in any combination thereof.

To attain this, the present invention generally comprises a plurality of elastic loads with each end of each elastic load having a fastening ring coupled thereto. A pair of elongate cords are provided also having a fastening ring couple to each end of the respective cord. Each cord also has a plurality of spaced apart and laterally positioned fastening rings coupled thereto between the ends of the respective cord. A pair of flexible annular handles are provided each having a fastening ring coupled thereto. A plurality of detachably fasteners are provided for detaching pairs of the fastening rings together into various configurations to permit a user to perform various resistance exercises.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new elastic exerciser system apparatus and method which has many of the advantages of the exerciser systems mentioned heretofore and many novel features that result in a new elastic exerciser system which is not anticipated, rendered obvious, suggested, or even implied by any of the prior art exerciser systems, either alone or in any combination thereof.

It is another object of the present invention to provide a new elastic exerciser system which may be easily and efficiently manufactured and marketed.

It is a further object of the present invention to provide a new elastic exerciser system which is of a durable and reliable construction.

An even further object of the present invention is to provide a new elastic exerciser system which is susceptible of a low cost of manufacture with regard to both materials and labor, and which accordingly is then susceptible of low prices of sale to the consuming public, thereby making such elastic exerciser system economically available to the buying public.

Still yet another object of the present invention is to provide a new elastic exerciser system which provides in the apparatuses and methods of the prior art some of the advantages thereof, while simultaneously overcoming some of the disadvantages normally associated therewith.

Still another object of the present invention is to provide a new elastic exerciser system for providing a portable exercise system so that a user may exercise therewith at any location.

Yet another object of the present invention is to provide a new elastic exerciser system which includes a plurality of elastic loads with each end of each elastic load having a fastening ring coupled thereto. A pair of elongate cords are provided also having a fastening ring couple to each end of the respective cord. Each cord also has a plurality of spaced apart and laterally positioned fastening rings coupled thereto between the ends of the respective cord. A pair of flexible annular handles are provided each having a fastening ring coupled thereto. A plurality of detachably fasteners are provided for detaching pairs of the fastening rings together into various configurations to permit a user to perform various resistance exercises.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
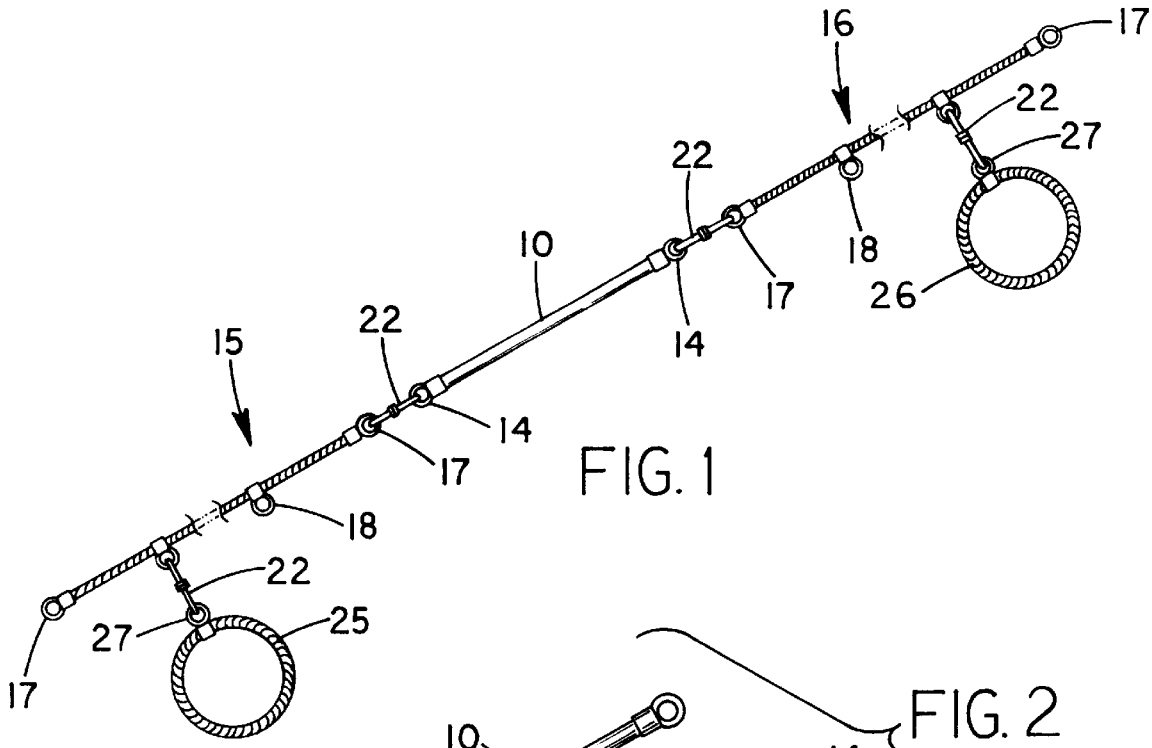
FIG. 1 is a schematic side view of an assembled elastic exerciser system according to the present invention.
Figure 2:
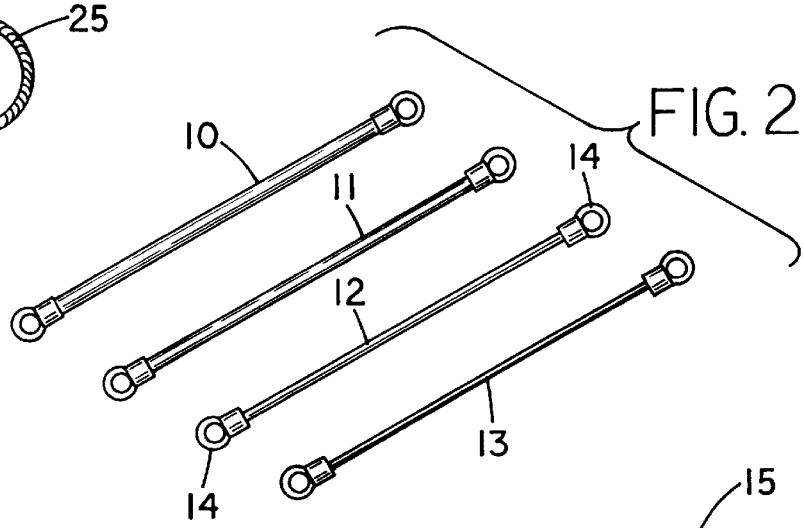
FIG. 2 is a schematic side view of the elastic loads of the present invention.

With reference now to the drawings, and in particular to FIGS. 1 through 9 thereof, a new elastic exerciser system embodying the principles and concepts of the present invention will be described.

As best illustrated in FIGS. 1 through 9, the elastic exerciser system generally comprises a plurality of elastic loads with each end of each elastic load having a fastening ring coupled thereto. A pair of elongate cords are provided also having a fastening ring couple to each end of the respective cord. Each cord also has a plurality of spaced apart and laterally positioned fastening rings coupled thereto between the ends of the respective cord. A pair of flexible annular handles are provided each having a fastening ring coupled thereto. A plurality of detachably fasteners are provided for detaching pairs of the fastening rings together into various configurations to permit a user to perform various resistance exercises.

In closer detail, the elastic exerciser system includes a plurality of elastic loads 10,11,12,13 (see FIG. 2) each comprising an elastomeric material and having a pair of opposite ends and a longitudinal axis extending between the ends of the respective elastic load. Each of the elastic loads has a length defined between the ends of the respective elastic load. Preferably, the lengths of the elastic loads are about equal to one another. The ends of the elastic loads each have a metal fastening ring 14 coupled thereto.

Each of the elastic loads is resiliently stretchable in outwardly directions collinear with the longitudinal axis of the respective elastic load. Each of the elastic loads requiring a predetermined amount of tensile force for stretching the respective load. The predetermined amount of tensile force is defined as the amount of force required to be pulled on the respective load to stretch it, whereby a less amount of force will not stretch the respective elastic load. Preferably, a first of the elastic loads 10 requires a first predetermined mounting tensile force for stretching the first elastic load. In this preferred embodiment, a second of the elastic loads 11 requires a second predetermined amount of tensile force greater than the first predetermined amount of tensile force for stretching the second elastic load, a third of the elastic loads 12 requires a third predetermined amount of tensile force greater than the second predetermined amount of tensile force for stretching the third elastic load, and a fourth of the elastic loads 13 requires a fourth predetermined amount of tensile force greater than the third predetermined amount of tensile force for stretching the fourth elastic load.

In an ideal illustrative embodiment, the first predetermined amount of tensile force is about 5 pounds of tensile force, the second predetermined amount of tensile force is about 10 pounds of tensile force, Ideally, the third predetermined amount of tensile force is about 20 pounds of tensile force, and Ideally, the fourth predetermined amount of tensile force is about 40 pounds of tensile force. This set of elastic loads allows a user to increase their load from 5 pounds to 75 pounds at 5 pound intervals.

Figure 3:
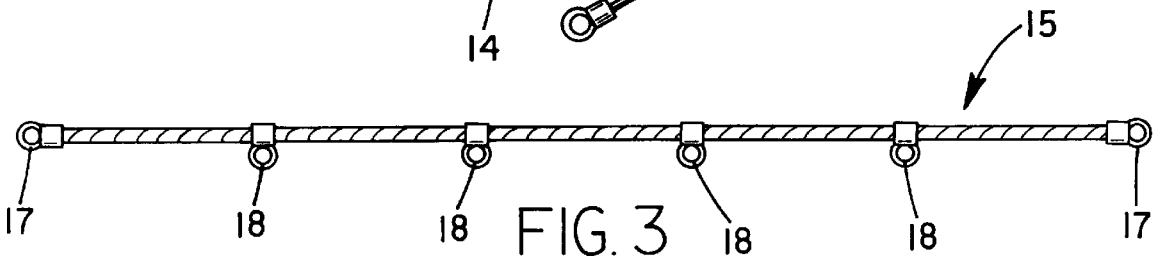
FIG. 3 is a schematic side view of a cord of the present invention.

With particular reference to FIG. 3, the system also includes a pair of elongate cords 15,16 each having a pair of opposite ends and a longitudinal axis extending between the ends of the respective cord. Like the elastic loads, the ends of the cords each have a metal fastening ring 17 coupled thereto. Each of the cords also have a plurality of spaced apart and laterally positioned fastening rings 18 coupled thereto between the ends of the respective cord. The laterally positioned fastening rings of each cord are arranged in a row between the ends of the respective cord and preferably spaced apart at generally equal intervals in the row.

Figure 9:
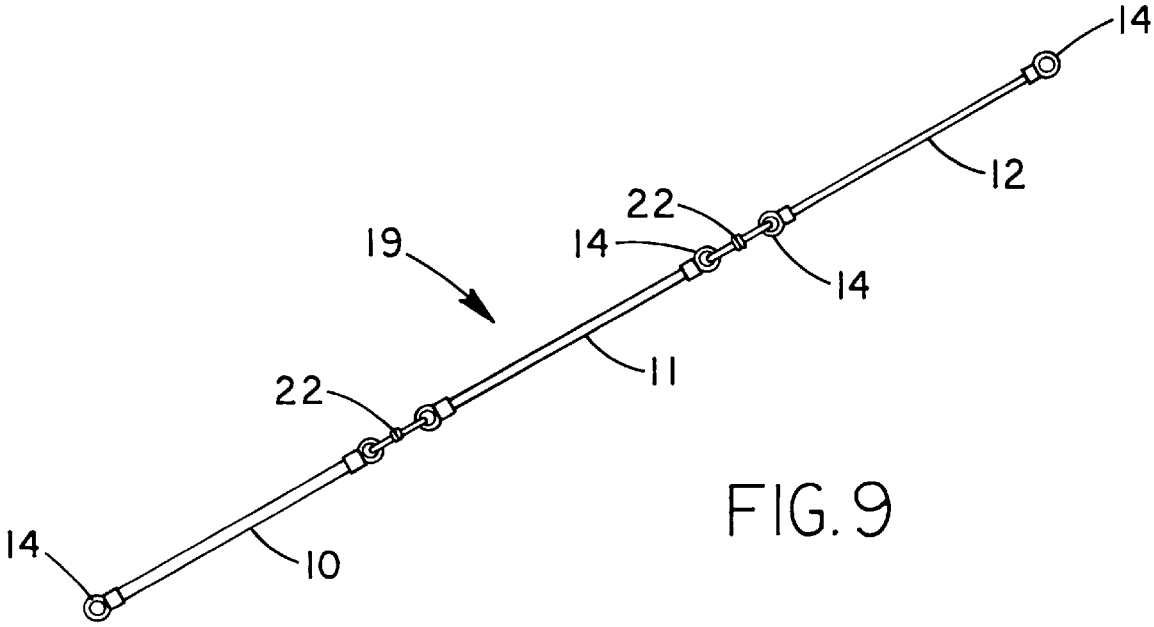
FIG. 9 is a schematic side view of a series of the elastic loads.

The ends the elastic loads each is detachably attachable to one another such that the elastic loads are arranged in series 19 as illustrated in FIG. 9. As illustrated in FIG. 1 in such as series (even comprising a single elastic load), at one end of the series an end of one of the cords is detachably attached thereto and at the other end of the series an end of the other cord is detachably attached thereto. As illustrated in FIG. 9, when the elastic loads are arranged in the linear series, an end of one elastic load is positioned adjacent to and detachably attached to an end of another adjacently positioned elastic load such that the linear series of elastic loads has an opposite pair of terminal free ends 20,21 each having a fastening ring located thereat. The fastening rings of each adjacent pair of ends of the elastic loads in the linear series of elastic loads are detachably attached together. The fastening ring located at one of the terminal ends of the series of elastic loads is detachably attached to a fastening ring of one end of one of the cords and the fastening ring located at the other of the terminal ends of the series of elastic loads is detachably attached to a fastening ring of one end of the other of the cords.

Figure 4:
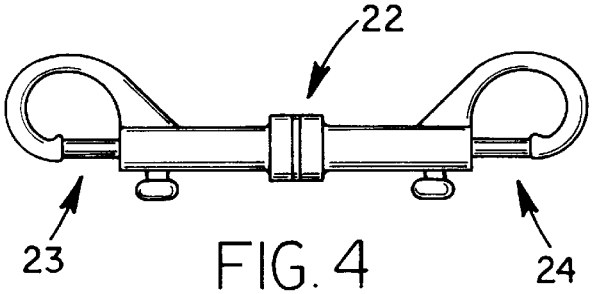
FIG. 4 is a schematic side view of a detachable fastener of the present invention.
Figure 5:
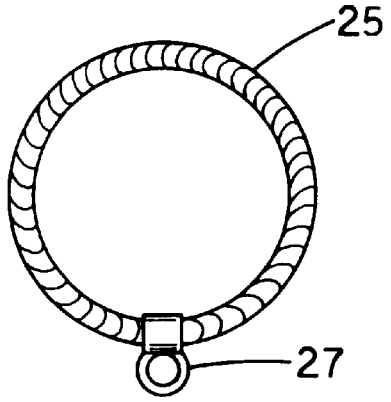
FIG. 5 is a schematic side view of an annular handle of the present invention.

The system also includes a plurality of detachably fasteners 22. Preferably, each pair of detachably attached fastening rings are detachably attached together by a corresponding one of the detachable fasteners. As illustrated in FIG. 4, each of the detachable fastener comprises a pair of oppositely extending spring bolt clips 23,24 coupled together. Each spring bolt clip is designed for fastening to a fastening ring of the elastic loads and the cords with one of the spring bolts of each detachably fastener is detachably attached to one fastening ring of the associated pair of adjacent fastening ring and the other of the spring bolts of each detachably fastener is detachably attached to the other fastening ring of the associated pair of adjacent fastening ring.

The system also includes a pair of flexible annular handles 25,26 each having a fastening ring 27 coupled thereto. In use, the annular handles are for grasping with a user's hand or extending a foot therethrough or even extending an secured structure to anchor the exerciser to the structure. The fastening ring of one of the annular handles may be detachably attached to the fastening ring of either the free end or one of the laterally positioned fastening rings of the one cord while the fastening ring of the other of the annular handles may be detachably attached to the fastening ring of either the free end or one of the laterally positioned fastening rings of the other cord as shown in FIG. 1. Like the other fastening rings, the fastening rings of the annular handles are detachably attached to their associated fastening ring of the respective cord by a corresponding one of the detachable fasteners.

In use, various strengthening exercises may be performed by using the handles to pull the elastic loads which provide the resistance for the exercise.

Figure 7:
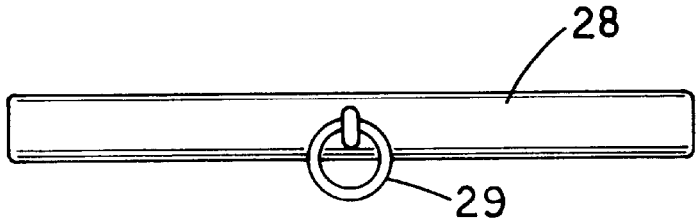
FIG. 7 is a schematic side view of the rowing handle.
Figure 8:
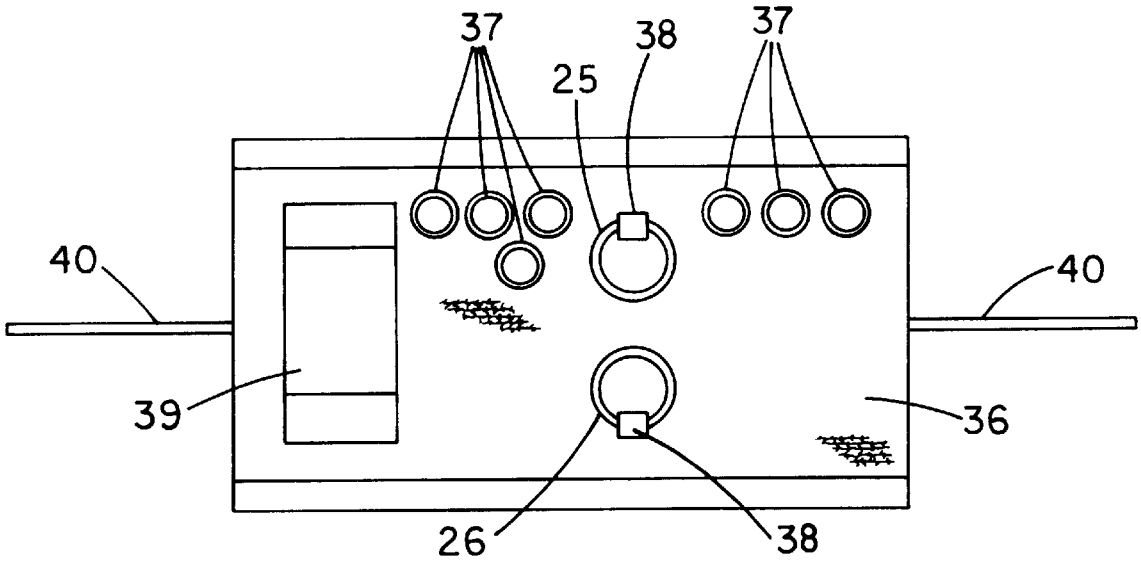
FIG. 8 is a schematic plan view of the carrying case roll of the present invention in an unrolled state.

Preferably, the system includes an elongate generally cylindrical rowing handle 28 as illustrated in FIG. 7. The rowing handle has a pair of opposite ends and a fastening ring 29 located between the ends of the rowing handle. In use, the fastening ring of the rowing handle is designed for detachably attachment to the fastening ring of an end of one of the cords, Ideally, one of the detachable fasteners is provided for detachably attaching the fastening ring of the rowing handle to the other associated fastening ring.

Figure 6:
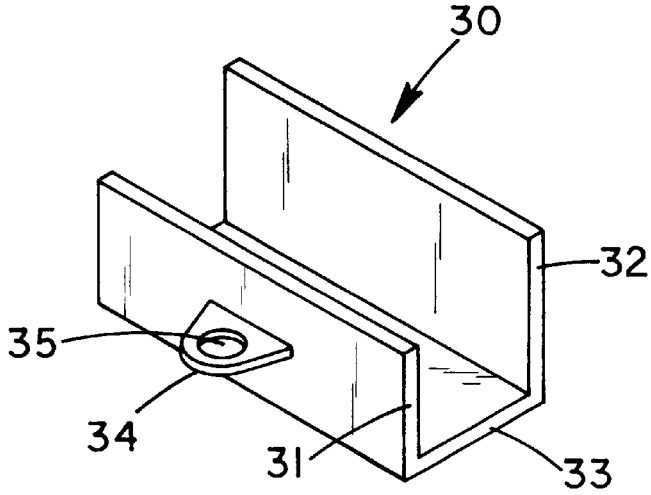
FIG. 6 is a schematic perspective view of the door anchor of the present invention.

Also preferably included in the system, as illustrated in FIG. 6, is a generally rectangular U-shaped door anchor 30 having a spaced apart pair of side walls 31,32 and a base wall 33 connecting the side walls together, the door anchor defining a channel for receiving a portion of a door therein to secure the exerciser to a door to perform various fixed end exercises with the exerciser. One of the side walls has a fastening tab 34 outwardly extending therefrom which has a hole 35 therethrough designed for extending therethrough a spring bolt clip of one of the detachable fasteners to permit detachable attachment of the fastening tab to one of the fastening rings of one of the cords. This allows anchoring of the exerciser to a door to perform fixed end exercises.

As best illustrated in FIG. 7, a carrying case roll is provided comprises a generally rectangular flexible panel 36 having a plurality of mounting rings 37 designed for detachably attaching the elastic loads and the cords thereto with the detachably fasteners. The panel has a pair of hook and loop fastener strips 38 coupled thereto for securing the annular handles to the panel. The panel preferably also has pocket 39 for receiving therein the door anchor and the rowing handle. The panel is designed for rolling up into a roll configuration with the elastic loads, cords, door anchor and the rowing handle wrapped up therein. The panel has a plurality of tie strings 40 for tying together when the panel is in the roll configuration such that the panel is held in the roll configuration.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An elastic exerciser system having components capable of being detachably attached together, comprising:

a plurality of elastic loads each having a pair of opposite ends and a longitudinal axis extending between said ends of the respective elastic load;

said ends of said elastic loads each having a fastening ring coupled thereto;

a pair of elongate cords each having a pair of opposite ends and a longitudinal axis extending between said ends of the respective cord;

said ends of said cords each having a fastening ring coupled thereto;

each of said cords each having a plurality of spaced apart and laterally positioned fastening rings coupled thereto between said ends of the respective cord;

a pair of flexible annular handles each having a fastening ring coupled thereto; and a plurality of detachably fasteners for detaching pairs of said fastening rings together.

2. The elastic exerciser system of claim 1, wherein each of said elastic loads is resiliently stretchable in outwardly directions collinear with said longitudinal axis of the respective elastic load, wherein each of said elastic loads requires a predetermined amount of tensile force for stretching the respective load.

3. The elastic exerciser system of claim 2, wherein a first of said elastic loads requires a first predetermined mounting tensile force for stretching said first elastic load, wherein a second of said elastic loads requires a second predetermined amount of tensile force greater than said first predetermined amount of tensile force for stretching said second elastic load, wherein a third of said elastic loads requires a third predetermined amount of tensile force greater than said second predetermined amount of tensile force for stretching said third elastic load, and wherein a fourth of said elastic loads requires a fourth predetermined amount of tensile force greater than said third predetermined amount of tensile force for stretching said fourth elastic load.

4. The elastic exerciser system of claim 3, wherein said first predetermined amount of tensile force is about 5 pounds of tensile force, wherein said second predetermined amount of tensile force is about 10 pounds of tensile force, wherein said third predetermined amount of tensile force is about 20 pounds of tensile force, and wherein said fourth predetermined amount of tensile force is about 40 pounds of tensile force.

5. The elastic exerciser system of claim 1, further comprising an elongate generally cylindrical rowing handle having a pair of opposite ends and a fastening ring located between said ends of said rowing handle, said fastening ring of said rowing handle being adapted for detachably attachment to said fastening ring of an end of one of said cords, wherein one of said detachable fasteners is provided for detachably attaching said fastening ring of said rowing handle to the other associated fastening ring.

6. The elastic exerciser system of claim 1, wherein each of said detachable fastener comprises a pair of oppositely extending spring bolt clips coupled together, each spring bolt clip being adapted for fastening to a fastening ring, one of said spring bolts of each detachably fastener being detachably attached to one fastening ring of the associated pair of adjacent fastening ring and the other of said spring bolts of each detachably fastener being detachably attached to the other fastening ring of the associated pair of adjacent fastening ring.

7. The elastic exerciser system of claim 1, further comprising a generally rectangular U-shaped door anchor having a spaced apart pair of side walls and a base wall connecting said side walls together, said door anchor defining a channel for receiving a portion of a door therein, one of said side walls having a fastening tab outwardly extending therefrom, said fastening tab having a hole therethrough adapted for extending therethrough a spring bolt clip of one of said detachable fasteners to permit detachable attachment of said fastening tab to one of said fastening rings of one of said cords.

8. The elastic exerciser system of claim 1, further comprising a carrying case roll comprising a generally rectangular flexible panel having a plurality of mounting rings adapted for detachably attaching said elastic loads and said cords thereto with said detachably fasteners, said panel having a pair of hook and loop fastener strips coupled thereto for securing said annular handles to said panel, said panel being adapted for rolling up into a roll configuration with said elastic loads, cords, door anchor and said rowing handle wrapped up therein, said panel having a plurality of tie strings for tying together when said panel is in said roll configuration such that said panel is held in said roll configuration.

9. An elastic exerciser system, comprising:

a plurality of elastic loads each having a pair of opposite ends and a longitudinal axis extending between said ends of the respective elastic load;

each of said elastic loads having a length defined between said ends of the respective elastic load, wherein said lengths of said elastic loads are about equal to one another;

each of said elastic loads being resiliently stretchable in outwardly directions collinear with said longitudinal axis of the respective elastic load;

each of said elastic loads requiring a predetermined amount of tensile force for stretching the respective load;

wherein a first of said elastic loads requires a first predetermined mounting tensile force for stretching said first elastic load;

wherein a second of said elastic loads requires a second predetermined amount of tensile force greater than said first predetermined amount of tensile force for stretching said second elastic load;

wherein a third of said elastic loads requires a third predetermined amount of tensile force greater than said second predetermined amount of tensile force for stretching said third elastic load;

wherein a fourth of said elastic loads requires a fourth predetermined amount of tensile force greater than said third predetermined amount of tensile force for stretching said fourth elastic load;

wherein said first predetermined amount of tensile force is about 5 pounds of tensile force, wherein said second predetermined amount of tensile force is about 10 pounds of tensile force, wherein said third predetermined amount of tensile force is about 20 pounds of tensile force, and wherein said fourth predetermined amount of tensile force is about 40 pounds of tensile force;

said ends of said elastic loads each having a fastening ring coupled thereto;

a pair of elongate cords each having a pair of opposite ends and a longitudinal axis extending between said ends of the respective cord;

said ends of said cords each having a fastening ring coupled thereto;

each of said cords each having a plurality of spaced apart and laterally positioned fastening rings coupled thereto between said ends of the respective cord, said laterally positioned fastening rings of each cord being arranged in a row between said ends of the respective cord and spaced apart at generally equal intervals in said row;

said elastic loads being arranged in a linear series of at least one elastic load with an end of one elastic load being positioned adjacent to and detachably attached to an end of another adjacently positioned elastic load such that said linear series of elastic loads has an opposite pair of terminal free ends each having a fastening ring located thereat;

wherein said fastening rings of each adjacent pair of ends of said elastic loads in said linear series of elastic loads are detachably attached together;

said fastening ring located at one of said terminal ends of said series of elastic loads being detachably attached to a fastening ring of one end of one of said cords, said fastening ring located at the other of said terminal ends of said series of elastic loads being detachably attached to a fastening ring of one end of the other of said cords;

a plurality of detachably fasteners;

wherein each pair of detachably attached fastening rings is detachably attached together by a corresponding one of said detachable fasteners;

a pair of flexible annular handles each having a fastening ring coupled thereto;

said fastening ring of one of said annular handles being detachably attached to said fastening ring of one of the laterally positioned fastening rings of the one cord;

said fastening ring of the other of said annular handles being detachably attached to said fastening ring of one of the laterally positioned fastening rings of the other cord;

wherein said fastening ring of each annular handle is detachably attached to the associated fastening ring of the respective cord by a corresponding one of said detachable fasteners;

an elongate generally cylindrical rowing handle having a pair of opposite ends and a fastening ring located between said ends of said rowing handle;

said fastening ring of said rowing handle being adapted for detachably attachment to said fastening ring of an end of one of said cords, wherein one of said detachable fasteners is provided for detachably attaching said fastening ring of said rowing handle to the other associated fastening ring;

each of said detachable fastener comprising a pair of oppositely extending spring bolt clips coupled together, each spring bolt clip being adapted for fastening to a fastening ring, one of said spring bolts of each detachably fastener being detachably attached to one fastening ring of the associated pair of adjacent fastening ring and the other of said spring bolts of each detachably fastener being detachably attached to the other fastening ring of the associated pair of adjacent fastening ring;

a generally rectangular U-shaped door anchor having a spaced apart pair of side walls and a base wall connecting said side walls together, said door anchor defining a channel for receiving a portion of a door therein;

one of said side walls having a fastening tab outwardly extending therefrom, said fastening tab having a hole therethrough adapted for extending therethrough a spring bolt clip of one of said detachable fasteners to permit detachable attachment of said fastening tab to one of said fastening rings of one of said cords;

a carrying case roll comprising a generally rectangular flexible panel having a plurality of mounting rings adapted for detachably attaching said elastic loads and said cords thereto with said detachably fasteners;

said panel having a pair of hook and loop fastener strips coupled thereto for securing said annular handles to said panel;

said panel having pocket for receiving therein said door anchor and said rowing handle; and said panel being adapted for rolling up into a roll configuration with said elastic loads, cords, door anchor and said rowing handle wrapped up therein, said panel having a plurality of tie strings for tying together when said panel is in said roll configuration such that said panel is held in said roll configuration.

* * * * *